US006257525B1

(12) United States Patent
Matlin et al.

(10) Patent No.: US 6,257,525 B1
(45) **Date of Patent: *Jul. 10, 2001**

(54) REMOTELY CONTROLLED AIRCRAFT

(75) Inventors: Tai Hoon Kim Matlin, Skokie; James Ashley Waring, Vernon Hill, both of IL (US)

(73) Assignee: Gray Matter Holdings, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/489,149

(22) Filed: Jan. 21, 2000

Related U.S. Application Data

(63) Continuation of application No. 09/232,224, filed on Jan. 19, 1999, now Pat. No. 6,145,789, which is a continuation-in-part of application No. 09/045,994, filed on Mar. 23, 1998, now abandoned.

(51) Int. Cl.[7] ..... A63H 27/08

(52) U.S. Cl. ..... 244/153 R; 244/137.4; 244/152; 244/155 R; 244/155 A

(58) Field of Search ..... 244/153 R, 137.4, 244/152, 155 R, 155 A, 137.1, 900, 901, 902, 154, 3; 292/201, 229, 129, 127, 227

(56) References Cited

U.S. PATENT DOCUMENTS

| | | | | |
|---|---|---|---|---|
| 1,925,427 | | 9/1933 | Wurtzer | 48/50 |
| 1,927,835 | | 9/1933 | Kellogg | 244/22 |
| 2,364,006 | | 11/1944 | Smith | 244/219 |
| 2,393,105 | * | 1/1946 | Hasselhorn | 89/1.5 |
| 2,493,704 | | 1/1950 | Tomczyk et al. | 244/154 |
| 2,548,748 | | 4/1951 | Stephan | 244/154 |
| 2,649,262 | | 8/1953 | Fahrney | 244/3 |
| 2,669,403 | | 2/1954 | McKay nee Milligan | 244/155 |
| 2,734,697 | | 2/1956 | Brow | 244/3 |
| 2,801,063 | | 7/1957 | O'Gorman | 244/154 |
| 2,827,252 | | 3/1958 | Pohl | 244/154 |
| 2,833,497 | | 5/1958 | Young | 244/155 |
| 3,001,747 | | 9/1961 | Hockett | 244/154 |
| 3,076,626 | | 2/1963 | Andrews | 244/154 |
| 3,204,368 | | 9/1965 | Effinger, Jr. et al. | 46/78 |
| 3,306,559 | | 2/1967 | Girard | 244/90 |
| 3,366,354 | | 1/1968 | Sterba | 244/154 |
| 3,456,901 | | 7/1969 | Wieland | 244/3 |
| 3,582,026 | | 6/1971 | Giolitto | 244/255 |
| 3,684,219 | | 8/1972 | King | 244/155 |
| 3,735,949 | | 5/1973 | Theis | 244/3 |
| 3,758,057 | | 9/1973 | Stratton | 244/154 |
| 3,770,230 | | 11/1973 | Johnston | 244/155 |
| 3,908,305 | | 9/1975 | Schroeder | 46/74 |
| 4,159,087 | | 6/1979 | Moomaw | 244/153 |
| 4,168,816 | | 9/1979 | Acosta | 244/154 |
| 4,180,221 | | 12/1979 | Harris | 244/13 |
| 4,194,317 | | 3/1980 | Kidd | 46/76 |
| 4,196,876 | * | 4/1980 | Maughlin et al. | 244/1 TD |
| 4,248,394 | | 2/1981 | Klumpp | 244/3 |

(List continued on next page.)

*Primary Examiner*—J. Woodrow Eldred
(74) *Attorney, Agent, or Firm*—Cooley Godward LLP

(57) ABSTRACT

A remotely controlled aircraft has a center member and a steering assembly. The steering assembly comprises a carriage, a remote control motor, a center member and a connecting arm. The carriage pivotably is attached to the center member. The remote control motor has a control arm and is disposed within the carriage. The center member arm has a first end and a second end. The first end of the center member arm is fixedly attached to the center member. The center member and the center member arm is arranged in a non-parallel manner. The connecting arm has a first end and a second end. The first end of the connecting arm is pivotably attached to the second end of the center member arm. The second end of the connecting arm is pivotably attached to the control arm of the remote control motor.

20 Claims, 16 Drawing Sheets

U.S. PATENT DOCUMENTS

| | | | | |
|---|---|---|---|---|
| 4,261,536 | | 4/1981 | Melcher et al. | 244/155 |
| 4,266,816 | * | 5/1981 | Mukai et al. | 292/129 |
| 4,349,169 | | 9/1982 | McAnally | 244/219 |
| 4,403,755 | | 9/1983 | Gutsche | 244/53 |
| 4,461,438 | | 7/1984 | Pook et al. | 244/153 |
| 4,533,099 | | 8/1985 | Stewart | 244/153 |
| 4,623,108 | | 11/1986 | Musick | 244/13 |
| 4,759,736 | | 7/1988 | Carlson | 446/62 |
| 4,781,344 | | 11/1988 | Thomas | 244/154 |
| 4,884,765 | | 12/1989 | Renecle | 244/153 |
| 5,094,638 | | 3/1992 | Kobayashi | 440/33 |
| 5,571,038 | | 11/1996 | Halling | 446/232 |
| 5,740,846 | * | 4/1998 | Larson et al. | 141/382 |
| 5,931,416 | | 8/1999 | Carpenter | 244/155 |

* cited by examiner

REMOTELY CONTROLLED AIRCRAFT

CROSS-REFERENCE TO RELATED APPLICATION

This is a continuation of application Ser. No. 09/232,224, filed on Jan. 19, 1999, now Pat. No. 6,145,789 which is a continuation-in-part of application Ser. No. 09/045,994, filed Mar. 23, 1998; now abandoned the entire contents of both applications are incorporated herein by reference.

BACKGROUND OF THE INVENTION

The resent invention relates generally to a remotely controlled aircraft. More specifically, the present invention relates to a remotely controlled aircraft having a remote control motor in the aircraft which can release the flight string at the aircraft and/or can control the flight direction of the aircraft.

Launching known remote-control glider systems is difficult. Typically, known glider systems are launched from a bungee cord connected to the ground, an airborne powered remote control airplane, a motor powered winch, or an elevated position (e.g., a cliff). Because these launch methods require additional equipment or a specific type of geography, these known aircraft systems are not desirable.

In an attempt to allow gliders to be used in more situations and geographic locations, some known systems combine a kite configuration with a glider configuration. For example, U.S. Pat. No. 2,669,403 issued to McKay nee Milligan discloses a main kite carrying a glider and a second smaller kite that travels the flight string of the main kite to release the glider once the main kite has obtained a sufficient altitude.

U.S. Pat. No. 4,159,087 issued to Moomaw and U.S. Pat. No. 1,927,835 issued to Kellogg each disclose a kite that flies as a glider after the flight string has been released at the location of the person controlling the kite once the kite has obtained a sufficient altitude. The Moomaw system further includes a motor mechanism on the glider that rewinds the flight string into the glider once the flight string has been released. These known systems, however, once the flight string has been released at a location on the ground, allow the flight string to dangle from the glider for at least a limited period of time during which the flight string can interfere the flight of the glider.

Furthermore, known systems do not have effective and simple mechanisms for steering a remotely controlled aircraft. For example, U.S. Pat. No. 4,194,317 issued to Kidd discloses remote control servomotors that control the position of a suspended pendulum weight. The pendulum weight is in addition to a separate landing system consisting of an undercarriage system having landing wheels. The undercarriage system is separate from the pendulum weight to provide a way of landing without damaging the servomotors. This known system suffers from the fact that pendulum weight combined with the undercarriage system unnecessarily adds weight, structure and complexity to the aircraft.

SUMMARY OF THE INVENTION

A remotely controlled aircraft has a center member and a steering assembly. The steering assembly comprises a carriage, a remote control motor, a center member and a connecting arm. The carriage pivotably is attached to the center member. The remote control motor has a control arm and is disposed within the carriage. The center member arm has a first end and a second end. The first end of the center member arm is fixedly attached to the center member. The center member and the center member arm is arranged in a non-parallel manner. The connecting arm has a first end and a second end. The first end of the connecting arm is pivotably attached to the second end of the center member arm. The second end of the connecting arm is pivotably attached to the control arm of the remote control motor.

DETAILED DESCRIPTION

In accordance with an embodiment of the present invention, a remote control (RC) motor disposed within the remotely controlled aircraft performs a number of functions including releasing of the flight string, controlling the flight direction of the aircraft and controlling the shape of the aircraft wing. Note that term "motor" is used herein to include any type of machine or engine that produces or imparts motion. The motor can be, for example, a magnetic actuator or a battery-powered motor. The motor can include an appropriate gear assembly to adjust the speed or torque between the motor and its control arm.

Although embodiments of the present invention are discussed primarily in reference to a glider, embodiments of the present invention can be implemented on other types of remotely controlled aircraft, such as a sailplane, airplane or dirigible. An airplane could be launched, for example, as a conventional kite and then use a motor to at least partially extend its flight time.

Figure 1:
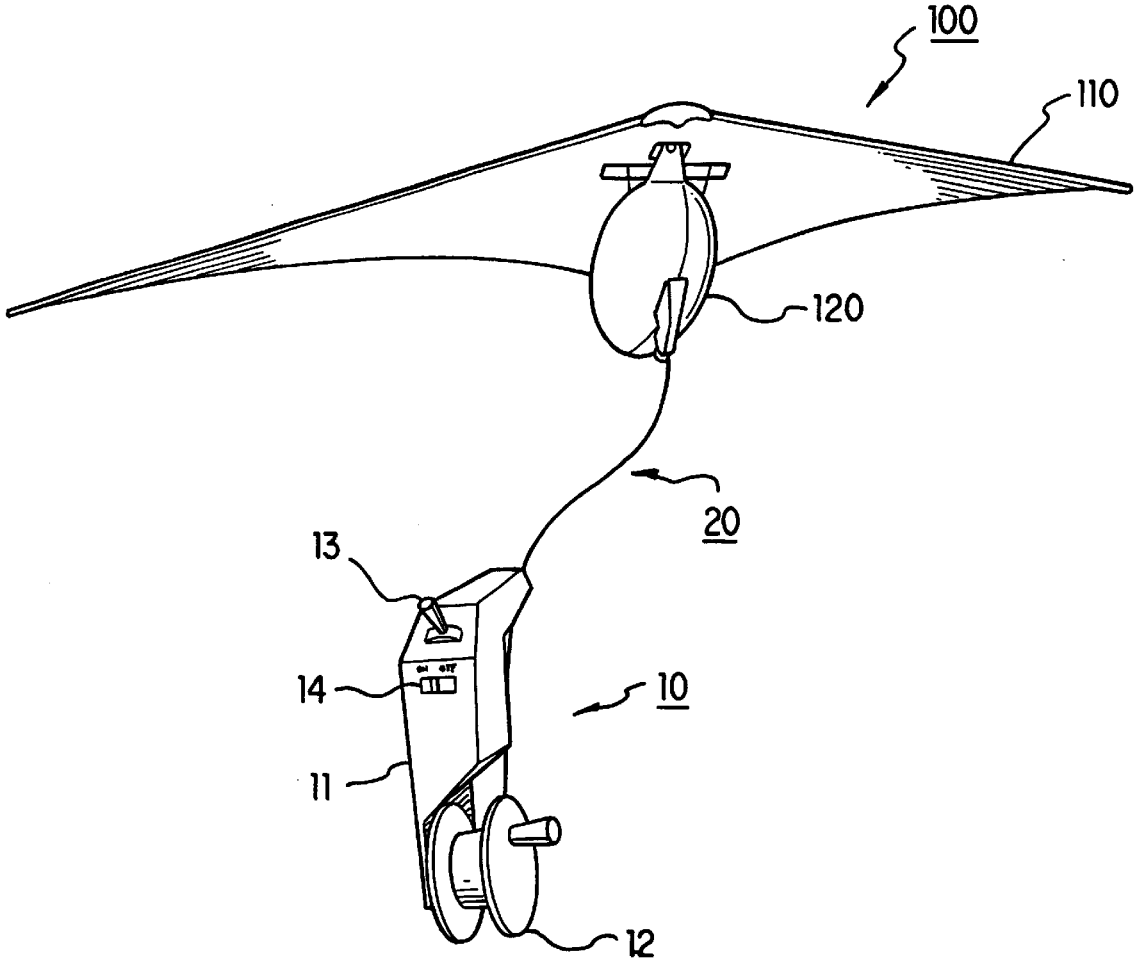
FIG. 1 illustrates a remotely controlled aircraft, according to an embodiment of the present invention.
Figure 2:
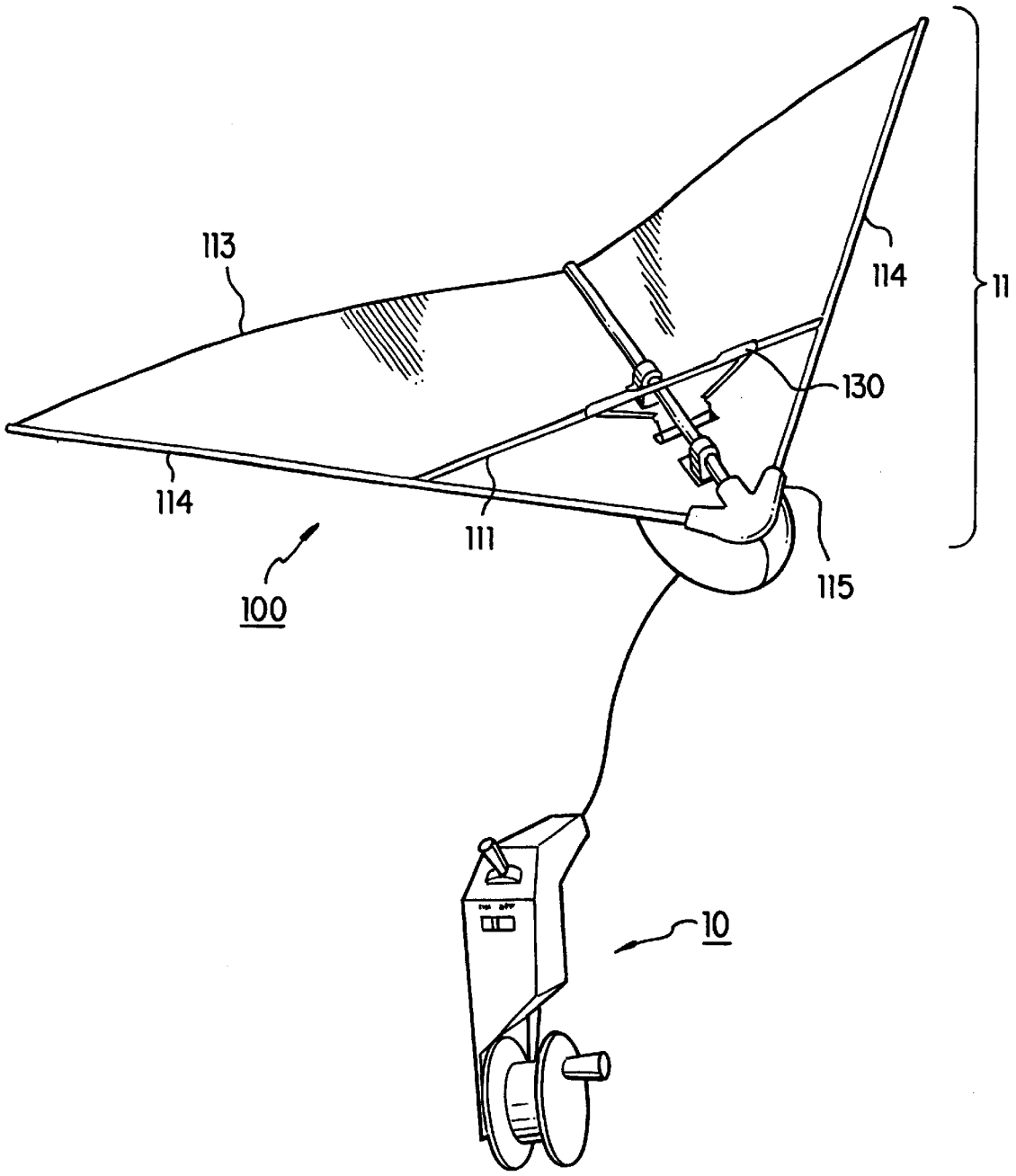
FIG. 2 illustrates a top view of the remotely controlled aircraft shown in FIG. 1 with its associated control unit.

FIG. 1 illustrates a remotely controlled aircraft, according to an embodiment of the present invention. Remotely controlled aircraft 100 includes wing assembly 110 and carriage 120. Carriage 120 of remotely controlled aircraft 100 is connected to control unit 10 by flight string 20. FIG. 2 illustrates a top view of remotely controlled aircraft with its associated control unit shown in FIG. 1.

Control unit 10 includes housing assembly 11, string reel 12, directional controller 13, on/off switch 14 and a remote control transmitter 15 (not shown in FIGS. 1 and 2). Housing assembly 11 houses string reel 12, directional controller 13, on/off switch 14 and remote control transmitter 15.

A user can hold control unit 10 to launch remotely controlled aircraft 100 airborne using the flight string 20 in a manner typical for launching conventional kites. Once the remotely controlled aircraft 100 is airborne to a sufficient altitude, the user can then operate directional controller 13 to activate remote control transmitter 14 to release flight string 20 from carriage 120 of remotely controlled aircraft 100. Note that the point at which flight string 20 is released is at carriage 120. By activating directional controller 13, a signal is sent via remote control transmitter 15 to an RC motor within carriage 120 as discussed more fully below.

Once flight string 20 has been released from remotely controlled aircraft 100, the user can then retrieve and store flight string 20 at a point on the ground. For example, a user can wind flight string 20 using string reel 12 of control unit 10 while also controlling the flight direction of remotely controlled aircraft 100 using directional controller 13. String reel 12 can be a reel manually turned or automatically turned.

Directional controller 13 can be any type of directional controller appropriate for the remote control motor (not shown in FIGS. 1 and 2) within carriage 120. In the embodiment shown in FIGS. 1 and 2, directional controller 13 is a three position joystick indicating a center static position, a rightward position, and a leftward position. In other embodiments, directional controller 13 is a joystick can having additional positions to activate, for example, additional RC channels associated with the RC motor and/or additional RC motors. In other embodiments, directional controller 13 is a set of buttons, such as a left activating button and a right activating button.

Upon activating directional controller 13, RC transmitter 15 sends a signal to remotely controlled aircraft 100 to control its flight direction as discussed more fully below. On/off switch 14 can be used to turn the remote control transmitter 15 off and on for operation.

As shown in FIG. 2 where a top view of remotely controlled aircraft 100 is shown, wing assembly 110 can include cross member 111, center member 112, wing membrane 113, exterior member 114, and nose member 115. Although the various members 111, 112, 114 and 115 provide wing membrane 113 sufficient rigidity for aerodynamic purposes, other configurations using fewer or more support members are possible. For example, a more rigid wing membrane can be selected so that some support members, such as the exterior members may not be necessary.

Figure 3:
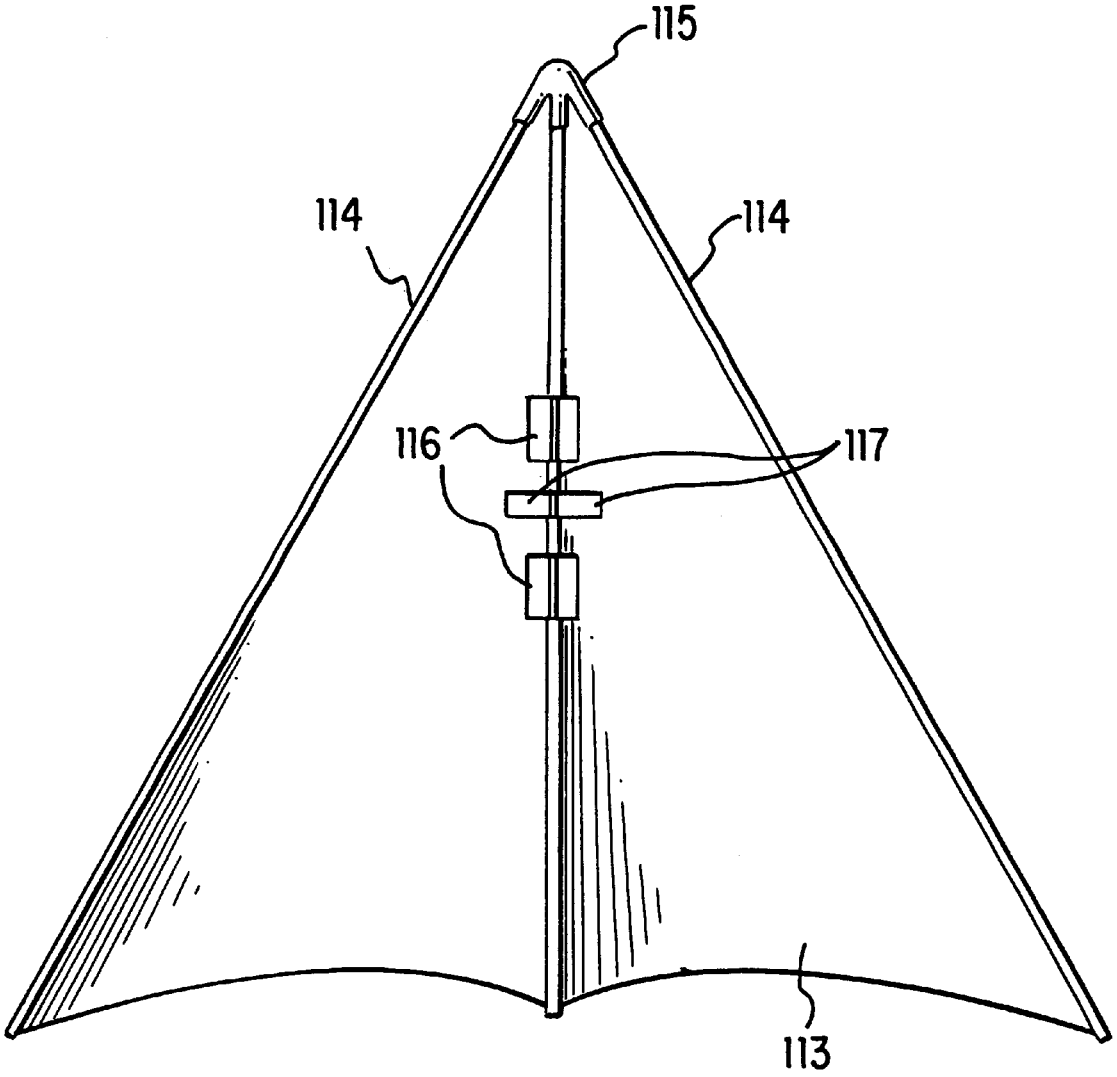
FIG. 3 illustrates a configuration of the wing membrane of the remotely controlled aircraft shown in FIGS. 1 and 2.

FIG. 3 illustrates a configuration of the wing membrane of the remotely controlled aircraft shown in FIGS. 1 and 2. Note that in the embodiment illustrated in FIG. 3, two sets of two apertures in wing membrane 113 are shown: center apertures 116 and off-center apertures 117. Center apertures 116 allow carriage 120 to connect to center member 112. Off-center apertures 117 allow shock-absorbing member 130 to connect to cross member 111 as discussed more fully below. The connection of carriage 120 to cross member 111 and center member 112 through wing membrane 113 can also be viewed in the top view of remotely controlled aircraft 100 shown in FIG. 2. Although the specific shapes of center apertures 116 and off-center apertures 117 are shown in FIG. 3 as rectangles, other shapes are possible which allow access for the relevant aircraft components to cross member 111.

Figure 4:
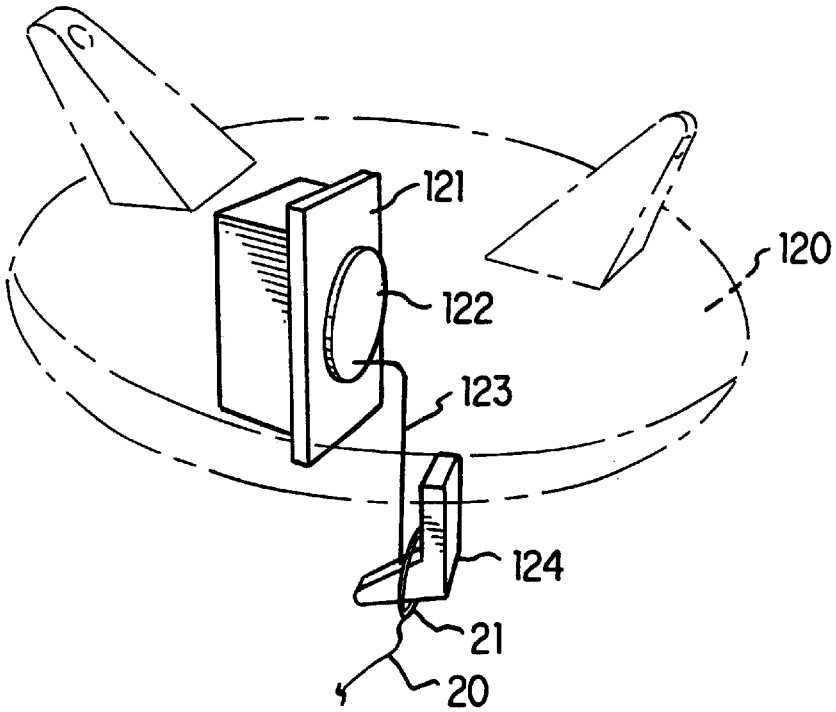
FIG. 4 illustrates a carriage and a releasible flight string of the remotely controlled aircraft shown in FIGS. 1 and 2.

FIG. 4 illustrates a carriage and a releasible flight string of the remotely controlled aircraft shown in FIGS. 1 and 2. As shown in FIG. 4, carriage 120 includes RC motor 121 which can include control arm 122. Control arm 122 is connected to release pin 123. Capture arm 124 is connected to carriage 120 at one end and is open at the other end. For example, capture arm 124 can be integrally formed with carriage 120.

Capture arm 124 can include a release pin aperture located near the open end of capture arm 124 into which the release pin 123 can slidably engage. The release pin aperture can be a hole which passes entirely or only partially through capture arm 124. Flight string 20 can include loop 21 which can fit over capture arm 124 so that loop 21 can be disposed between release pin receptacle and the end of capture arm 124 that connects to carriage 120. In this manner, flight string 20 can be connected to carriage 120 and, of course, remotely controlled aircraft 100.

Capture arm 124 can have, for example, an L shape and allow loop 21 of flight string 20 to fit over the open end of capture arm 124. Capture arm 124 can absorb shock to carriage 120 when remotely controlled aircraft 100 lands. In other words, when remotely controlled aircraft 100 lands, carriage 120 and possibly capture arm 124 are the points at which remotely controlled aircraft 100 impacts the ground. The shock absorbing qualities of capture arm 124 are possible where capture arm 124 can vertically flex upon impact. Although capture arm 124 is shown in FIG. 4 with an L shape, other shapes are possible, such as a C shape or a straight-angled shape.

Figure 5:
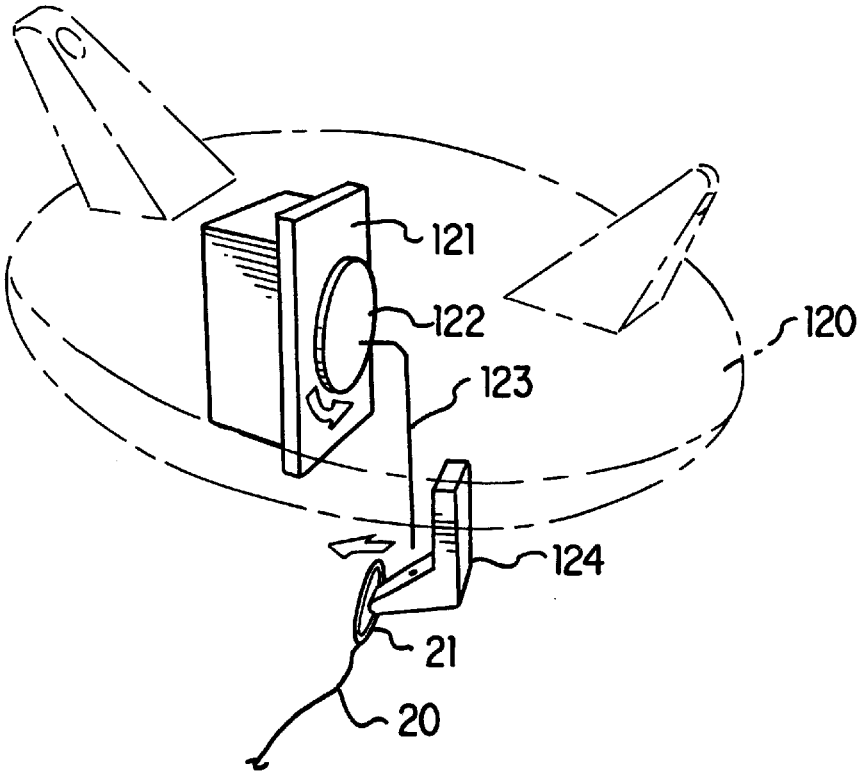
FIG. 5 illustrates the flight string being released from the carriage shown in FIG. 4.

FIG. 5 illustrates the flight string being released from the carriage shown in FIG. 4. When RC motor 121 receives a signal sent by RC transmitter 15 of control unit 10, control arm 122 rotates thereby bringing release pin 123 upward in a direction away from capture arm 124. By moving release pin 123 away capture arm 124, release pin 123 is moved out of the release pin receptacle. Once release pin 123 has been moved out of the release pin receptacle of capture arm 124, flight string 20 and its loop 21 slide or move out of the capture arm 123, thereby disconnecting flight string 20 from carriage 121 and, consequently, remotely controlled aircraft 100.

Note that control arm 122 of RC motor 121 can rotate in either direction to release thereby pin 123 from the release pin receptacle of capture arm 124. This occurs because release pin 123 can be connected to control arm 122 of RC motor 121 at the lower most part of control arm 122. When the user activates directional controller 13 of control unit 10, a signal is sent to RC motor 121 upon which control 122 rotates either clockwise or counter clockwise to move release pin 123 away from capture arm 124.

The mechanism for remotely releasing the flight string from the aircraft, an example of which is shown in FIGS. 4 and 5, can be combined with mechanisms for remotely controlling the flight direction of the aircraft after release of the flight string. In some embodiments, the remote release of the flight string and the remote control of the flight direction can be accomplished with the same RC motor. In one embodiment, for example, a single control rod (not shown) can connect the control arm of the RC motor shown in FIGS. 4 and 5 to a rudder (not shown) located, for example, at the rear of the aircraft carriage. In this embodiment, upon receiving a signal activating the control arm of the RC motor, the control arm rotates thereby releasing the flight string from the capture arm and thereby controlling the rudder direction. Other embodiments discussed below control the flight direction of the aircraft without the use of a rudder.

Figure 8:
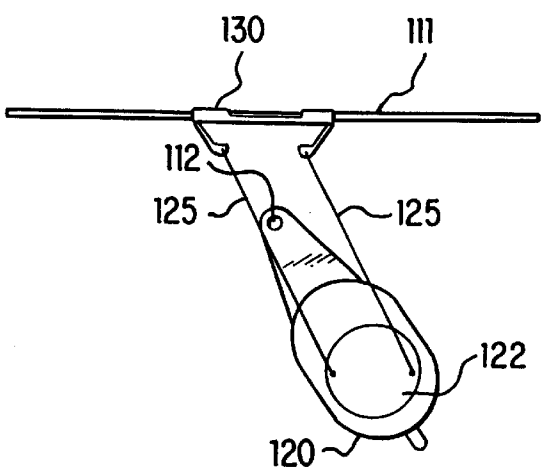
FIGS. 6 through 8 illustrate a front view of the remote control motor coupled to the cross member of the wing assembly shown in FIGS. 1 and 2.
Figure 7:
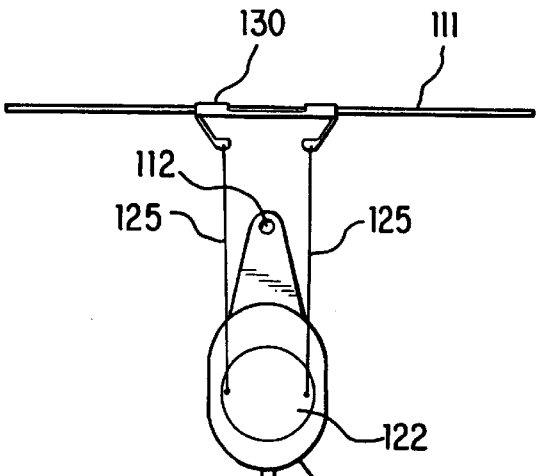
Figure 6:
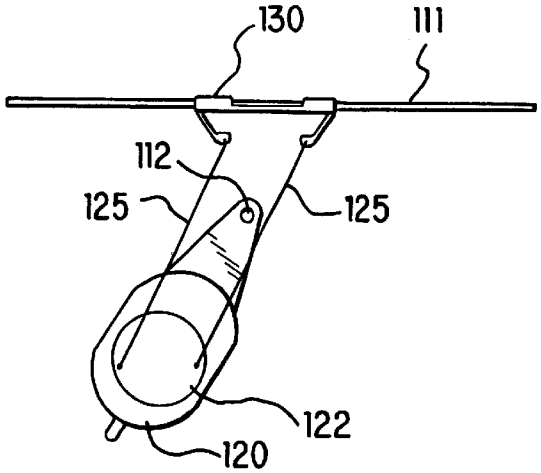

FIGS. 6 through 8 illustrate a front view of the RC motor coupled to the cross member of the wing assembly shown in FIGS. 1 and 2. As shown in FIGS. 6 through 8, RC motor 121 includes control arm 122 which is connected to control rods 125. Control rods 125 are connected to shock absorbing member 130 which is connected to cross member 111 of wing assembly 110 (not shown in FIGS. 6 through 8, but see FIG. 2). Carriage 120 is rotatably connected to center member 112.

FIG. 7 illustrates the position of control arm 122 and RC motor 121 when centered. RC motor 121 and control arm 122 are centered when remotely controlled aircraft 100 is in the kite configuration before flight string 20 has been released and when the remotely controlled aircraft 100 has a straight flight direction after the kite string 20 has been released.

FIG. 6 shows a position of RC motor 121 and control rods 125 when the RC motor 121 has been activated by receiving a signal from RC transmitter 15 of control unit 10 shown above in FIG. 1 and 2. Upon receiving the signal from remote control transmitter 15, control arm 122 rotates, thereby causing carriage 120 to pivot around center member 112 due to the rigidity of control rods 125 which are connected to control arm 122 and shock absorbing member 130. By rotating the position of carriage 120 about center member 112, the flight direction of remotely controlled aircraft 100 correspondingly can change.

As shown in FIG. 6 where the front of remotely controlled aircraft 100 is coming out of the page, by rotating the position of carriage 120 with respect to center member 112, the direction of remotely controlled aircraft 100 changes to the right from the perspective on the aircraft facing forward. In other words, by changing the center of gravity of carriage 120 and, correspondingly remotely controlled aircraft 100, to the right, the flight direction of remotely controlled aircraft 100 would also change to the right.

Similar to FIG. 6 where the position of carriage 120 has been rotated with respect to center member 112, FIG. 8 also illustrates the position of carriage 120 being rotated in the opposite direction with respect to center member 112. By rotating the position of carriage 120 with respect to center member 112 to the left, the direction of remotely controlled aircraft 100 changes to the left from the perspective on the aircraft facing forward. In other words, by changing the center of gravity of carriage 120 and, correspondingly remotely controlled aircraft 100, to the left, the flight direction of remotely controlled aircraft 100 would also change to the left.

Figure 9:
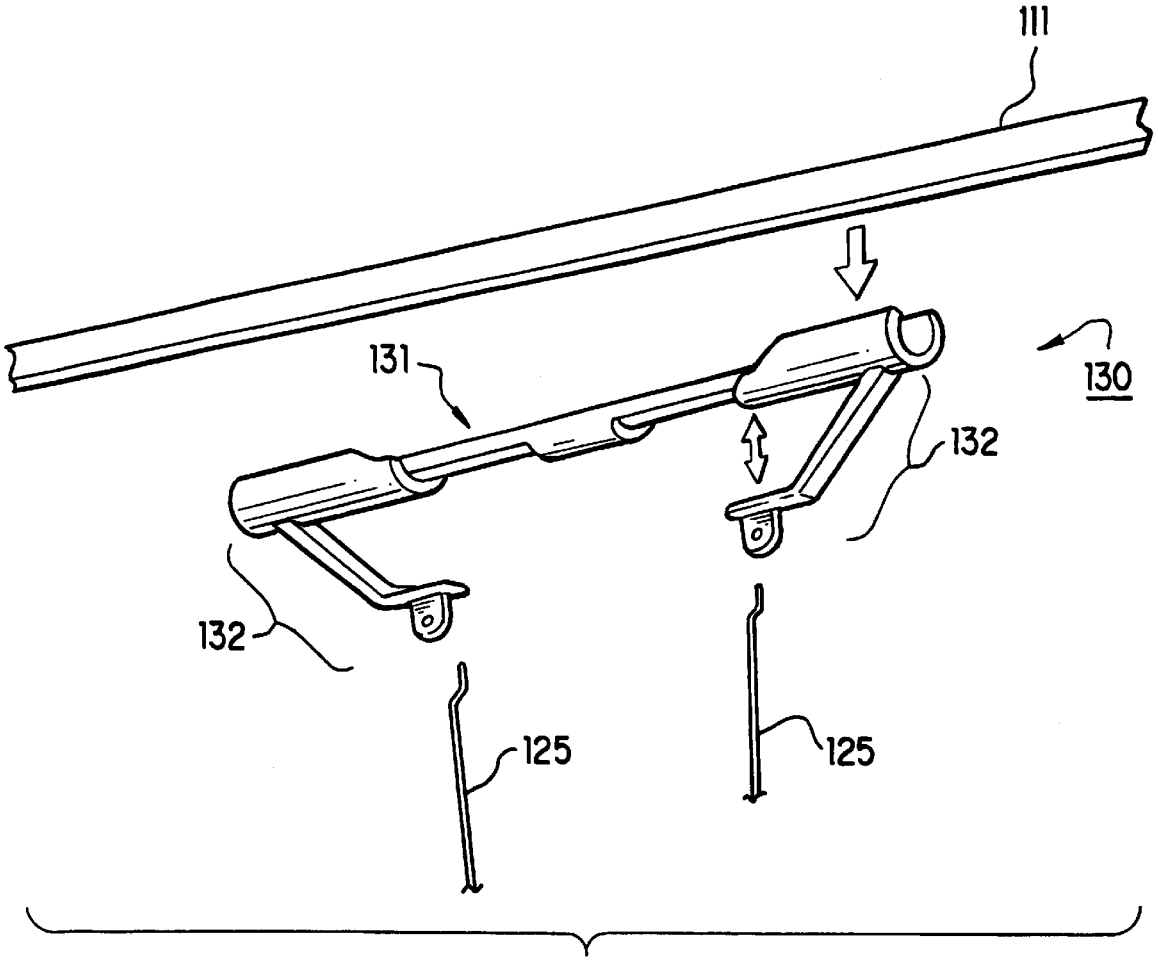
FIG. 9 illustrates a shock absorbing member of the remote control aircraft shown in FIGS. 1 and 2.

FIG. 9 illustrates a shock absorbing member of the remotely controlled aircraft shown in FIGS. 1 and 2. Shock absorbing member 130 includes main member 131 and arms 132. Main member 131 can be, for example, integrally formed with arms 132. Main member 131 of shock absorbing member 130 can be connected to cross member 111. For example, as shown in FIG. 9, main member 131 of shock absorbing member 130 can snugly fit or snap onto cross member 111.

Each arm 132 of shock absorbing member 130 can include a portion to be connected to one control rod 125. Both arms 132 can be flexible to allow shock to be absorbed between RC motor 121 and center member 111 thereby preventing the gears of RC motor 121 from being stripped upon carriage 120 impacting the ground during landing. For example, when remotely controlled aircraft 100 lands on the ground, carriage 120 will likely impact the ground at an angle thereby pushing carriage 120 further away from the centered position. Unless the coupling between control arm 122 and cross member 111 is flexible, the gears of RC motor 121 would be stripped upon impact; shock absorbing member 130 absorbs the shock of impact thereby preventing the gears of RC motor 121 from being stripped.

Although a particular configuration for shock absorbing member 130 is shown in FIG. 9, many other configurations are possible. For example, the particular open L-shaped configuration of arms 132 is not required; rather, arms 132 could have different types of L shapes or could be made of a solid material which sufficiently allowed shock to be absorbed. Similarly, main member 131 of shock absorbing member 130 can have different configurations as well. For example, shock absorbing member 130 could be connected to cross member 111 by integrally forming cross member 111 with shock absorbing member 130.

Figure 12:
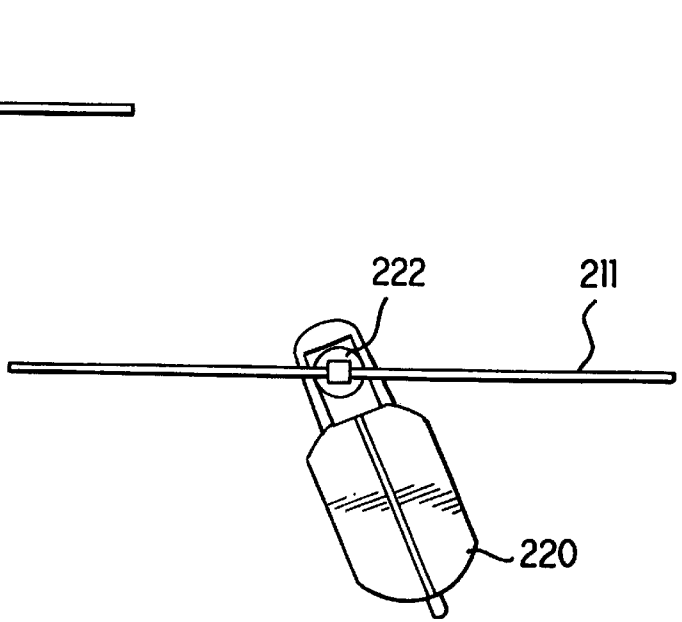
FIGS. 10 through 12 illustrate a front view of the remote control motor coupled to a cross member of a wing assembly, according to an alternative embodiment of the present invention.
Figure 11:
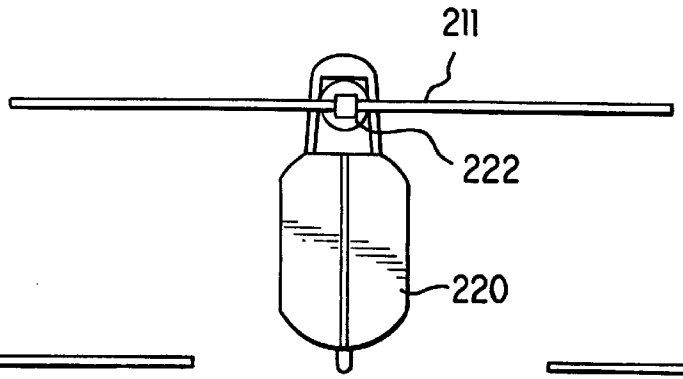
Figure 10:
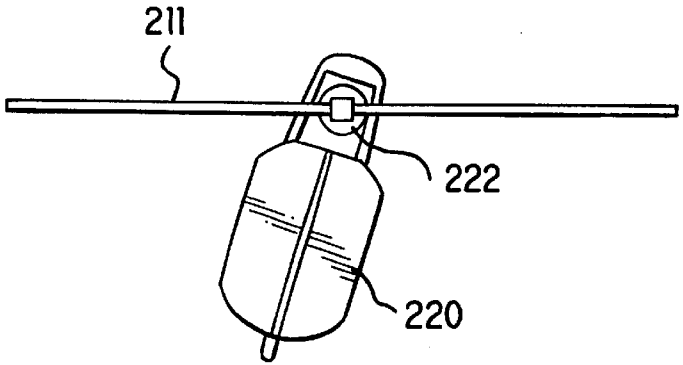

FIGS. 10 through 12 illustrate a front view of the RC motor coupled to a cross member of a wing assembly, according to an alternative embodiment of the present invention. FIGS. 10 through 12 illustrate an alternative manner by which a carriage can be coupled to a cross member of a wing assembly and rotated with respect to the cross member thereby changing the flight direction of the remotely controlled aircraft. As shown in FIGS. 10 through 12, the control arm 222 can be connected directly to cross-member 211 without the use of control rods.

FIG. 11 illustrates when carriage 220 is in a center position. Carriage 220 is centered when the remotely controlled aircraft is in the kite configuration before the flight string has been released and when the remotely controlled aircraft has a straight flight direction after the kite string has been released.

When the RC motor is activated, thereby causing control arm 222 to rotate, carriage 220 can be rotated with respect to cross member 211. As shown in FIG. 10 where the front of the remotely controlled aircraft is coming out of the page, by rotating the position of carriage 220 with respect to cross member 211, the flight direction of the remotely controlled aircraft changes to the right from the perspective on the aircraft facing forward. As shown in FIG. 12 where the front of the remotely controlled aircraft is coming out of the page, by rotating the position of carriage 220 with respect of cross member 211, the flight direction of the remotely controlled aircraft changes to the left from the perspective on the aircraft facing forward.

Figure 15:
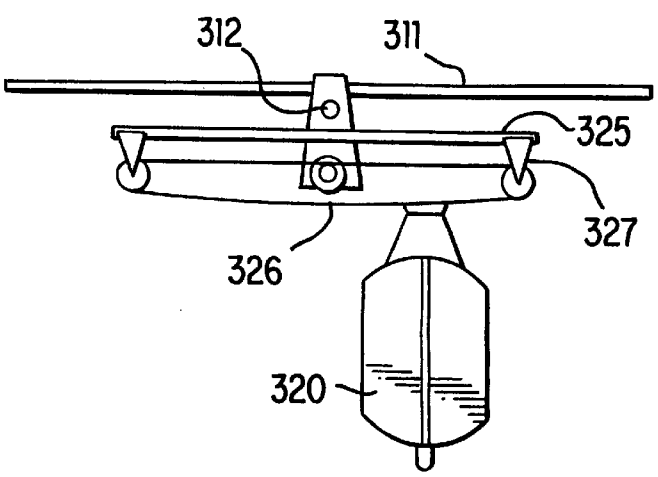
FIGS. 13 through 15 illustrate a front view of a translating assembly coupled to a cross member of a remotely controlled aircraft, according to an alternative embodiment of the present invention.
Figure 14:
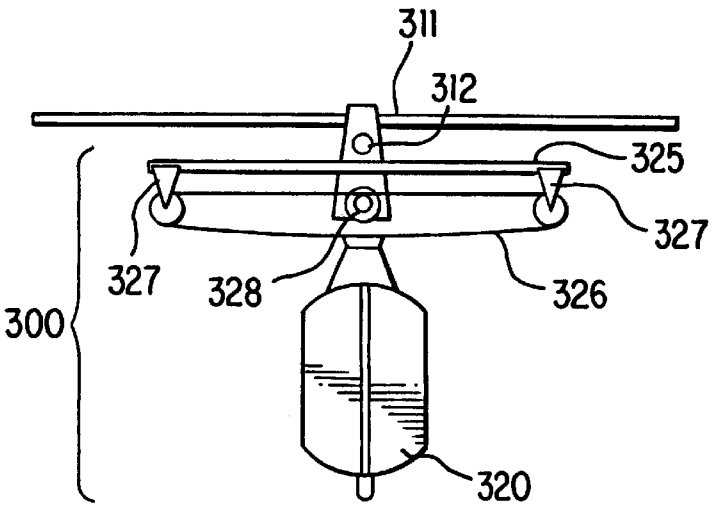
Figure 13:
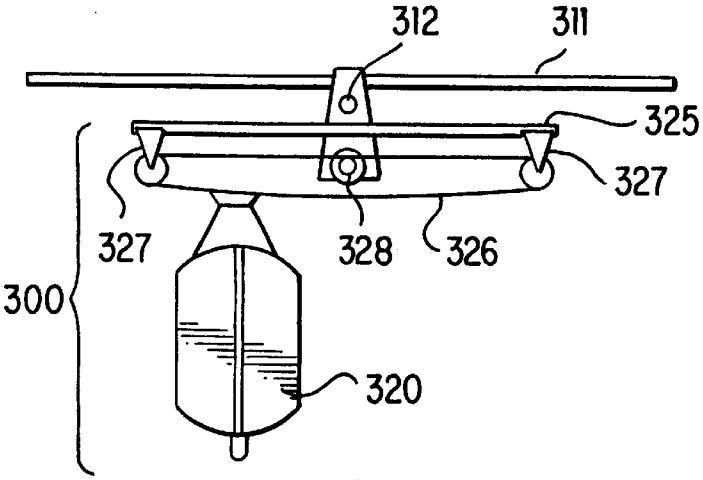

FIGS. 13 through 15 illustrate a front view of a translating assembly coupled to a cross member of a remotely controlled aircraft, according to an alternative embodiment of the present invention. FIGS. 13 through 15 show the aircraft where the front of the remotely controlled aircraft is coming out of the page.

Translating assembly 300 is connected to cross member 311 and center member 312; translating assembly 300 includes mount member 325, belt 326, pulleys 327, carriage 320 and control arm 328 of an RC motor (not shown). Carriage 320 is connected to a section of belt 326 opposite the section of belt 326 tangentially engaged with control arm 328. In this embodiment, mount member 325 is substantially parallel to cross member 311 of the aircraft.

FIG. 14 illustrates when carriage 320 is in a center position. Carriage 320 is centered when the remotely controlled aircraft is in the kite configuration before the flight string has been released and when the remotely controlled aircraft has a straight flight direction after the kite string has been released.

When the RC motor is activated thereby causing control arm 322 to rotate and belt 326 to move around pulleys 327, carriage 320 laterally translates along with belt 326 so that carriage 320 is located off center with respect to center member 312 of the aircraft from the perspective on the aircraft facing forward. As shown in FIG. 13, when control arm 322 rotates clockwise, carriage 320 is located to the right with respect to center member 312 and the flight direction of the remotely controlled aircraft changes to the right. As shown in FIG. 15, when control arm 322 rotates clockwise, the flight direction of the remotely controlled aircraft changes to the left.

Figure 17:
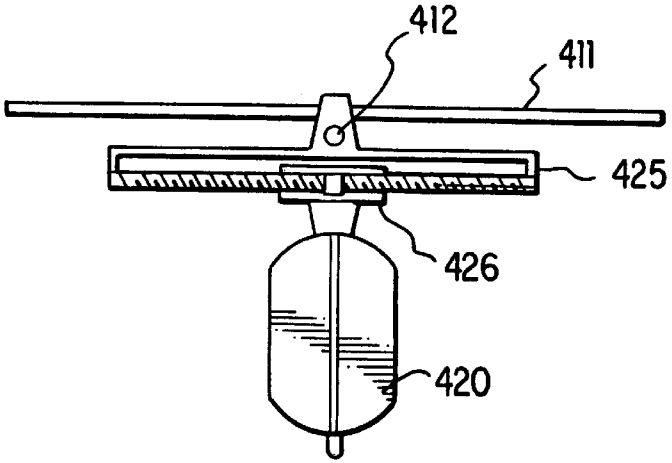
FIGS. 16 through 18 illustrate a front view of a translating assembly coupled to a cross member of a remotely controlled aircraft, according to an alternative embodiment of the present invention.
Figure 18:
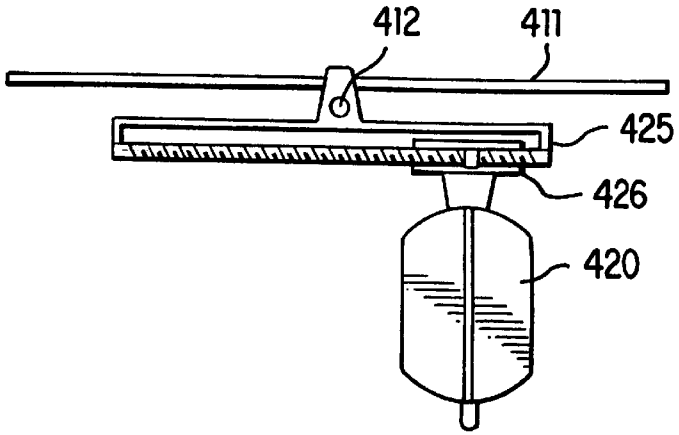
Figure 16:
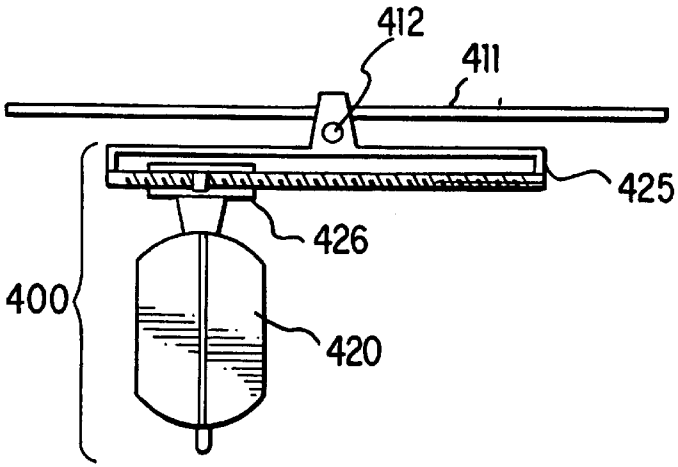

FIGS. 16 through 18 illustrate a front view of a translating assembly coupled to a cross member of a remotely controlled aircraft, according to an alternative embodiment of the present invention. FIGS. 16 through 18 show the aircraft where the front of the remotely controlled aircraft is coming out of the page.

Translating assembly 400 is connected to cross member 411 and center member 412; translating assembly 400 includes mount member 425, carriage 420 and worm gear 426 of an RC motor (not shown). In this embodiment, mount member 425 is substantially parallel to cross member 411 of the aircraft.

FIG. 17 illustrates when carriage 420 is in a center position. Carriage 420 is centered when the remotely controlled aircraft is in the kite configuration before the flight string has been released and when the remotely controlled aircraft has a straight flight direction after the kite string has been released.

When the RC motor is activated thereby causing worm gear 426 to rotate about the threaded portion of mount section 425, carriage 420 laterally translates along mount section 425 so that carriage 420 is located off center with respect to center member 412 of the aircraft from the perspective on the aircraft facing forward. As shown in FIG. 16, when worm gear 426 rotates in one direction, carriage 420 is located to the right with respect to center member 412 and the flight direction of the remotely controlled aircraft changes to the right. As shown in FIG. 18, when worm gear 426 rotates in the direction opposite of that shown in FIG. 16, the flight direction of the remotely controlled aircraft changes to the left.

Figure 19:
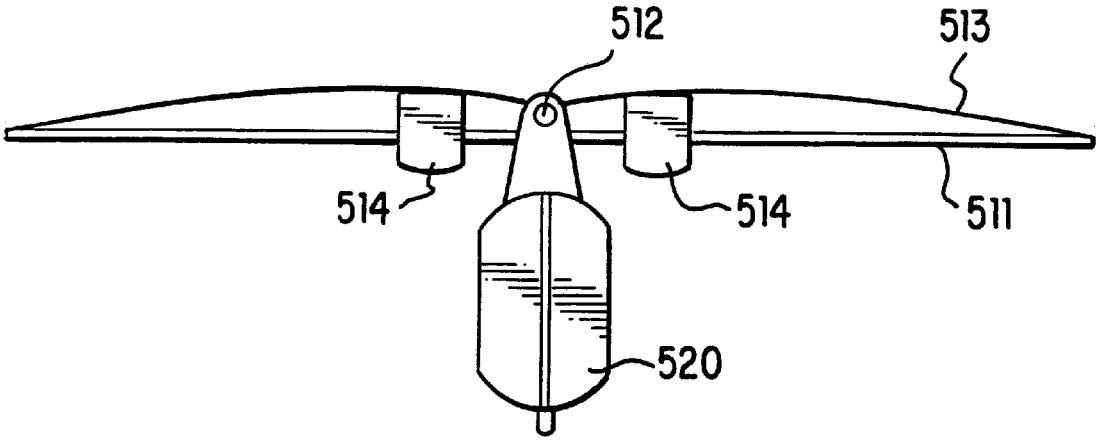
FIG. 19 illustrates a front view of a remotely controlled aircraft, according to another embodiment of the present invention.
Figure 20:
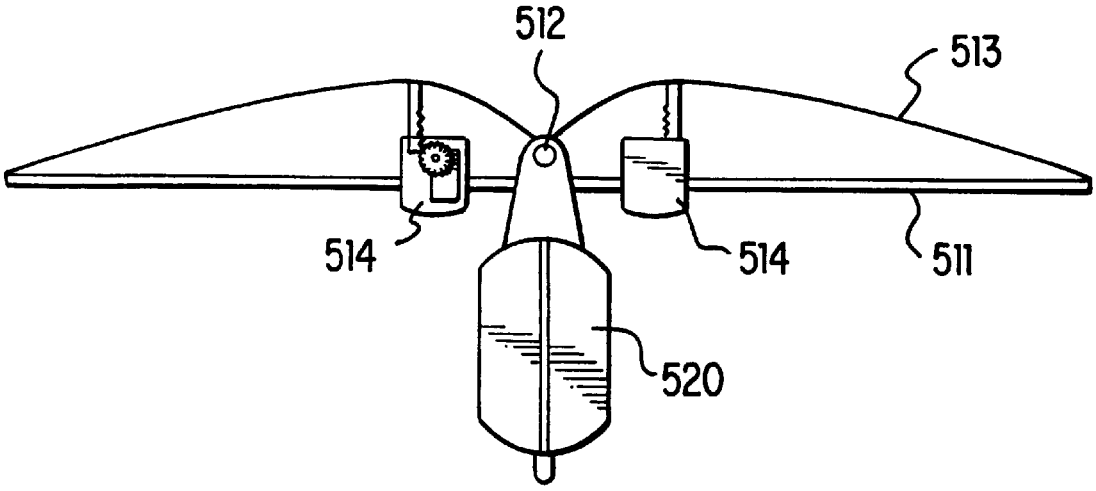
FIG. 20 illustrates a front view of the remotely controlled aircraft shown in FIG. 19 with the wing membrane having a modified shape.

FIGS. 19 and 20 illustrates a front view of a remotely controlled aircraft, according to an embodiment of the present invention. FIGS. 19 and 20 show the aircraft where the front of the remotely controlled aircraft is coming out of the page.

Carriage 520 is connected to cross member 511 and center member 512. In this embodiment, center member 512 is below cross member 511; both center member 512 and cross member 511 are below wing membrane 513. Two actuators 514 are connected to cross member 511 and interact with wing membrane 513.

Each actuator 514, for example, can include an RC motor connected to a telescoping rod in a rack-and-pinion configuration. The exterior end of the telescoping rod is arranged in contact with wing membrane 513. In one embodiment, the two actuators 514 are controlled together so that both extend or retract their respective telescoping rods substantially in parallel. In this embodiment, actuators 514 modify the shape of wing membrane 513 to change remotely the aerodynamic characteristics of the aircraft thereby changing its lift and drag characteristics without changing the flight direction.

In another embodiment, the two actuators 514 are controlled together so that both extend or retract their respective telescoping rods substantially in opposition. In other words, when one telescoping rod extends, the other telescoping rod retracts to the same extent. In this embodiment, actuators 514 modify the shape of wing membrane 513 to change remotely the flight direction of the aircraft.

In another embodiment, the actuators are independently controlled by separate RC channels so that their respective telescoping rods can extend or retract independently. Consequently, the actuators can modify the shape of the wing membrane to change remotely the aerodynamic characteristics of the aircraft thereby changing its lift and drag characteristics, and/or changing its flight direction.

FIG. 20 illustrates a front view of the remotely controlled aircraft shown in FIG. 19 with the wing membrane having a modified shape. When a user on the ground activates a directional controller of a control unit, a signal is sent from the RC transmitter of the control unit to actuators 514. As shown in FIG. 20, when a signal is received by actuators 514, the respective telescoping rods of actuators 514 are telescoped outward thereby modifying the shape of wing membrane 513. By modifying the shape of wing membrane 513, the aircraft characteristics can be controlled. For example, by modifying the shape of wing membrane 513 from that shown in FIG. 19 and that shown in FIG. 20, the aerodynamic characteristics of the aircraft, i.e., the lift and drag characteristics, can be remotely controlled.

Figure 21:
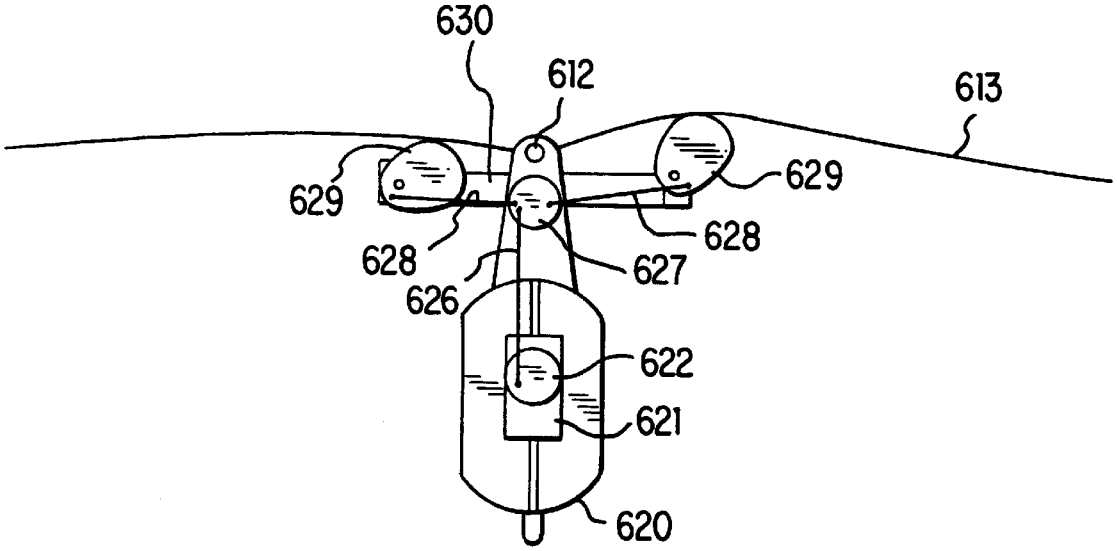
FIGS. 21 and 22 illustrate a front view of a remotely controlled aircraft with a wing membrane having a modified shape, according to another embodiment of the present invention.
Figure 22:
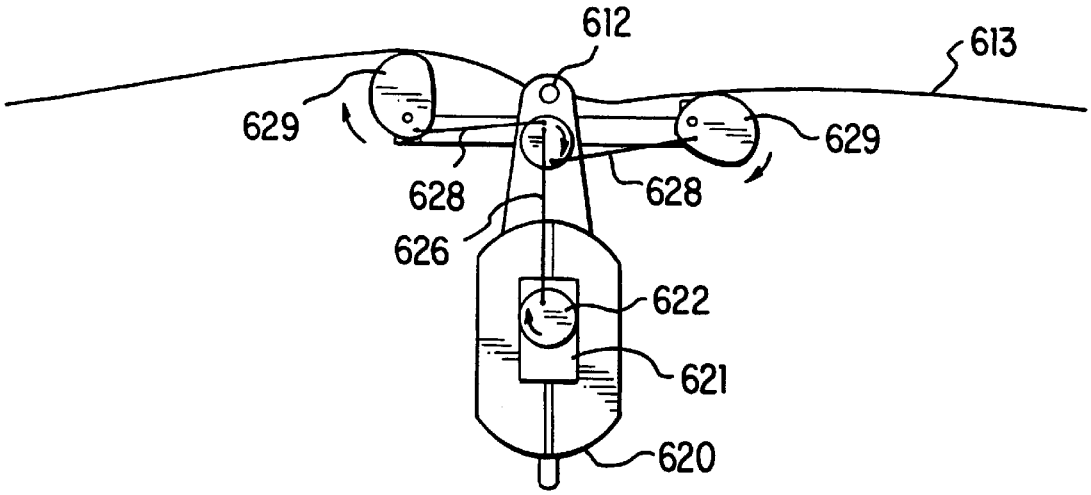

FIGS. 21 and 22 illustrate a front view of a remotely controlled aircraft with a wing membrane having a modified shape, according to another embodiment of the present invention. FIGS. 21 and 22 show the aircraft where the front of the remotely controlled aircraft is coming out of the page.

Carriage 620 is connected to center member 612 and includes a single actuator. The actuator includes RC motor 621, control arm 622, main rod 626, second control arm 627, cam rods 628, cams 628 and cam post 630. Main rod 626 is connected between control arm 622 and second control arm 627. Each cam rod 628 connects one cam 628 to second control arm 628. Each cam 628 is pivotally mounted at opposite ends of cam post 639. Cams 630 contact wing membrane 613.

As RC motor 621 receives a signal from a RC transmitter (not shown) in a control unit (not shown), RC motor 621 correspondingly turns control arm 622 which turns second control arm 627 due to main rod 626. As second control arm 627 turns, each cam rod 628 causes its respective cam 628 to rotate about its own pivot point on cam post 630. By rotating about their own pivot points on cam post 630, cams 630 modify the shape of wing membrane 613 to remotely change the flight direction of the aircraft.

In another embodiment, the cams are pivotally mounted on the cam post so that they rotate in a mirrored fashion. In other words, the cams mounted on the cam post so that as change the shape to the wing membrane symmetrically; as one cam rotates and changes the wing membrane shape on one side of the center member, the other cam rotates and changes the wing membrane shape on the other side of the center member so the same extent. By arranging the cams to allow symmetrical change of the wing membrane, the aerodynamic characteristics of the aircraft, i.e., the lift and drag characteristics, can be remotely controlled.

Figure 23:
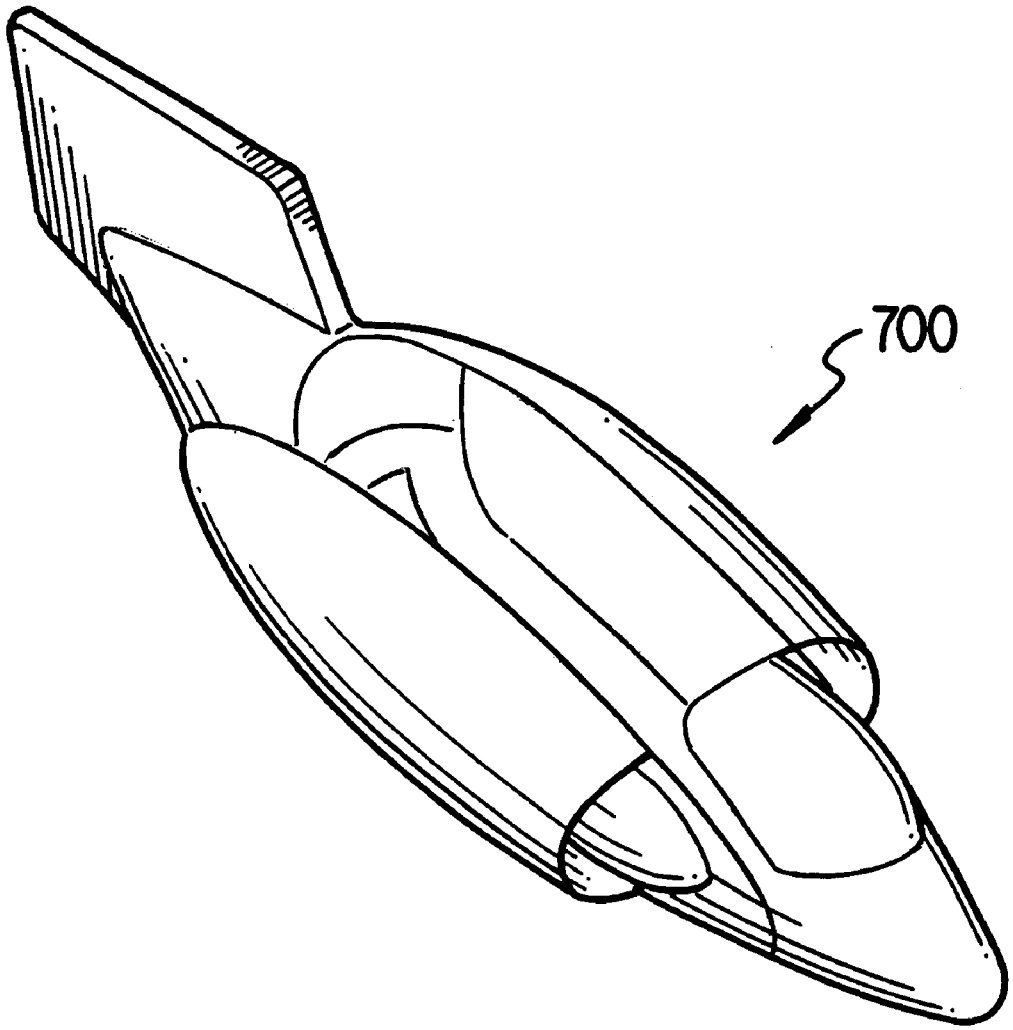
FIG. 23 illustrates an attachment body for the carriage of a remotely controlled aircraft, according to another embodiment of the present invention.

FIG. 23 illustrates an attachment body for the carriage of a remotely controlled aircraft, according to an embodiment of the present invention. Attachment body 700 can have any type of appropriate shape, typically differing from the carriage. Attachment body 700 can be attached to the carriage by fitting snugly or snapping onto the carriage thereby allowing different attachment bodies to be interchanged to vary the appearance of the remotely controlled aircraft. As shown in FIG. 23, attachment body 700 has a shape like a rocket ship. Alternatively, attachment body 700 can be shaped like a plane, blimp, etc.

Figure 24:
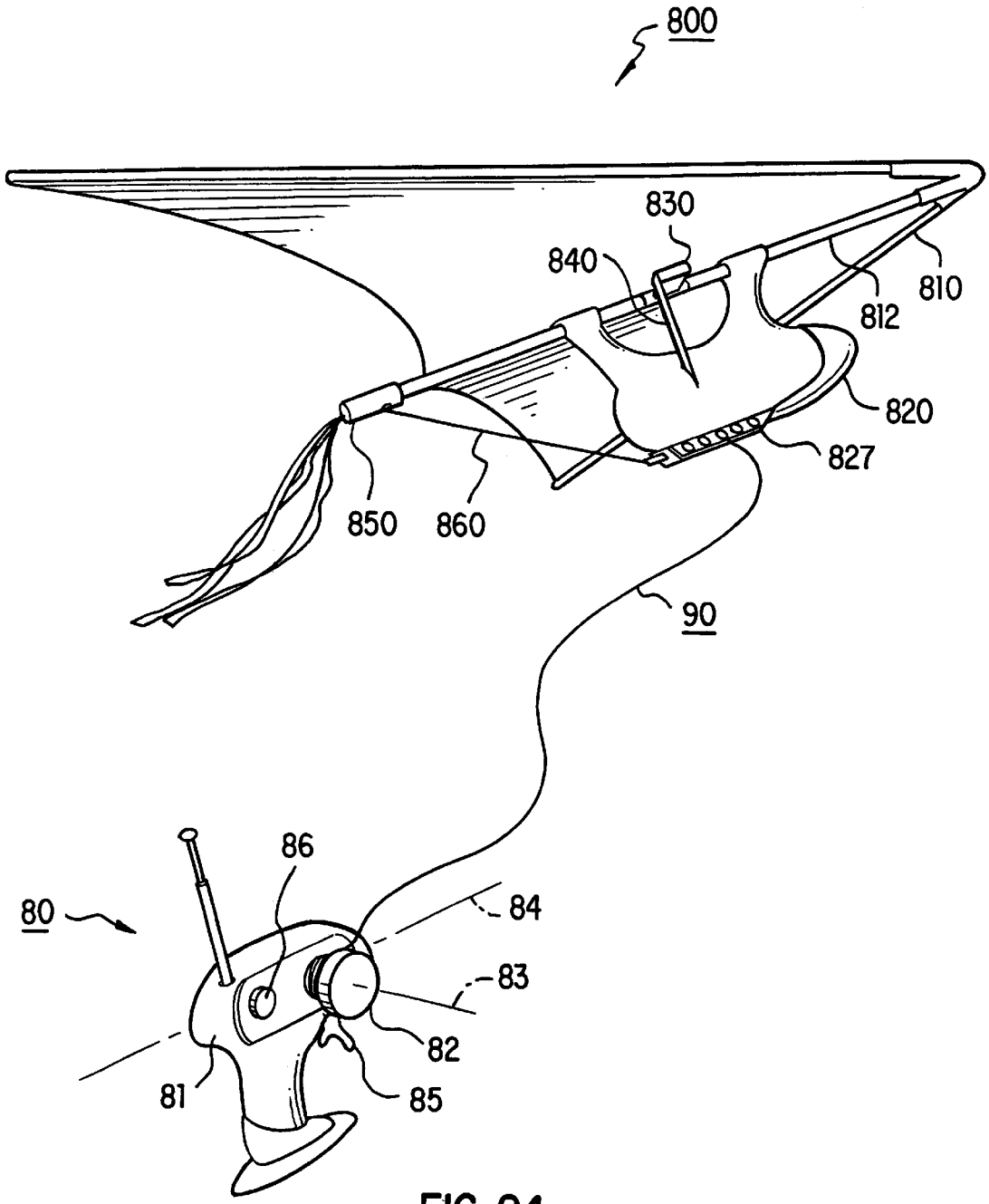
FIG. 24 illustrates a remotely-controlled aircraft, according to another embodiment of the present invention.

FIG. 24 illustrates a remotely-controlled aircraft, according to another embodiment of the present invention. Remotely controlled aircraft 800 includes wing assembly 810 and carriage 820. Remotely-controlled aircraft 800 also includes center member 812, center member arm 830 and push rod 840 which are discussed in detail below in connection with FIGS. 29–31. When the remotely-controlled aircraft 800 is in the kite mode (as shown in FIG. 24), carriage 820 of remotely-controlled aircraft 800 is connected to control unit by a kite mode assembly that includes at least the flight string 90, string clip 827, the tail weight 850, and tail weight line 860.

Figure 25:
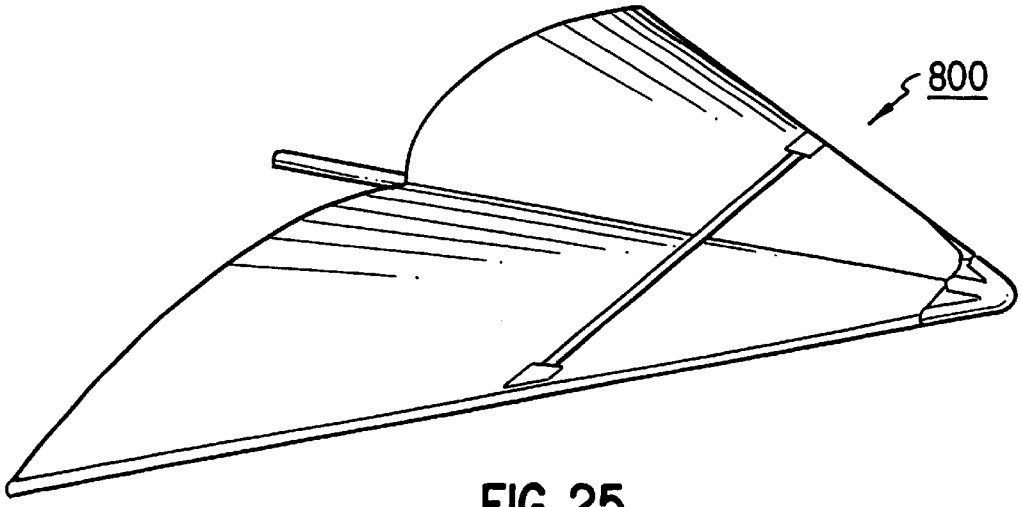
FIG. 25 illustrates a top view of the remotely-controlled aircraft with its associated control unit shown in FIG. 24 after the flight string has been released.
Figure 26:
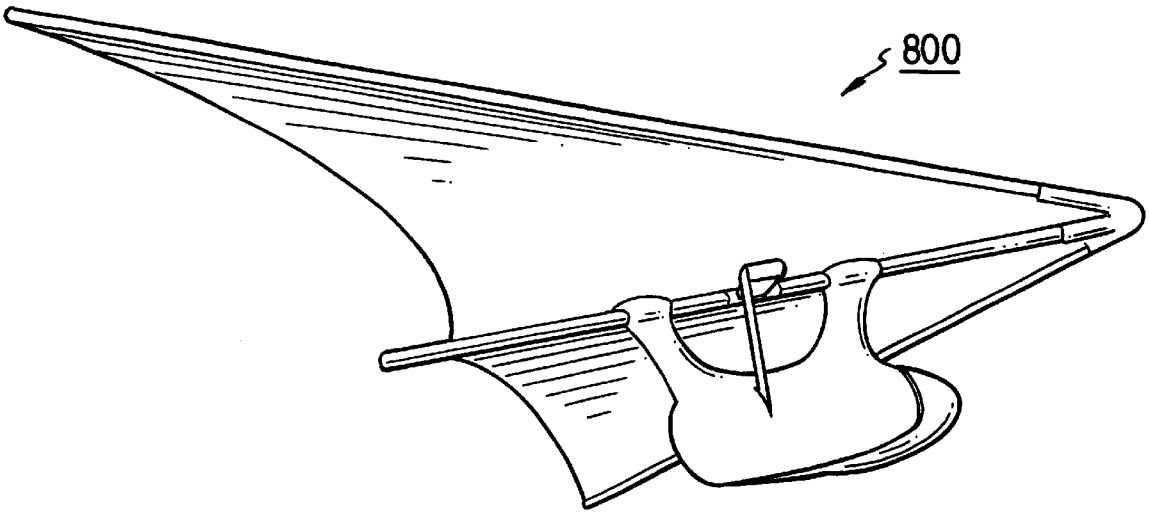
FIG. 26 illustrates a bottom view of the remotely-controlled aircraft with its associated control unit shown in FIG. 24 after the flight string has been released.

FIG. 25 illustrates a top view of the remotely-controlled aircraft with its associated control unit shown in FIG. 24 after the flight string has been released and the remotely-controlled aircraft is in the glider mode. FIG. 26 illustrates a bottom view of the remotely-controlled aircraft with its associated control unit shown in FIG. 24 after the flight string has been released and the remotely-controlled aircraft is in the glider mode.

The kite mode assembly separates from the carriage 820 when the string clip 827 disconnects from the carriage 820 upon receiving a RC signal transmitted from the separation controller 86 from the control unit 80. When the string clip 827 separates, tension on the tow weight line 860 is released enabling tail weight 850 to separate from center member 812 thereby completely separating the kite mode assembly from the remotely-controlled aircraft 800. The tow weight line 860 can be made of, for example, an elastic material that is stretched when the remotely-controlled aircraft 800 is in the kite mode and when the string clip 827 and the tow weight 850 are in place on the carriage 820 and center member 812, respectively. The tail weight 850 provides a distribution of weight that allows the remotely-controlled aircraft 800 to fly effectively when in the kite mode; the tail weight 850 is separated from the remotely-controlled aircraft 800 to allow the remotely-controlled aircraft 800 to fly effectively when in the glider mode.

Control unit 80 includes housing assembly 81, string spool 82, a directional controller 85, a separation controller 86, an on/off switch (not shown) and a remote control transmitter (not shown). Directional controller 85 can be, for example, a pistol-type trigger where moving the trigger forward corresponds to one direction of the remotely-controlled aircraft 800 and moving the trigger backward corresponds to the other direction of the remotely-controlled aircraft 800. Separation controller 86 can be any type of controller that sends a RC signal to the remotely-controlled aircraft 800 to release the kite mode assembly. The directional controller 85 and the separation controller 86 can be incorporated into a single device.

String spool 82 is disposed within housing assembly 81. For example, string spool 82 can be attached to the side of the housing assembly 81 so that the central axis 83 of the string spool 82 is substantially perpendicular to the central axis 84 of the control unit 80. When the remotely-controlled aircraft 800 is in flight in the kite mode, the control unit 80 is typically held by a user so that the central axis 84 of the control unit 80 is substantially parallel to the flight direction of the remotely-controlled aircraft 800. In this situation, the flight string 90 remains wound on the string spool. By the user rotating the control unit 80 so that the central axis of the string spool 82 is substantially parallel to the flight direction of the remotely-controlled aircraft 800, the flight string 90 automatically unwinds from the string spool 82 as the remotely-controlled moves away from the user.

Once flight string 90 has been released from remotely controlled aircraft 800, the user can then retrieve and store flight string 90 at a point on the ground. For example, a user can wind flight string 90 around the string spool 82 manually while also controlling the flight direction of remotely controlled aircraft 800 using the directional controller of control unit 80.

Figure 27:
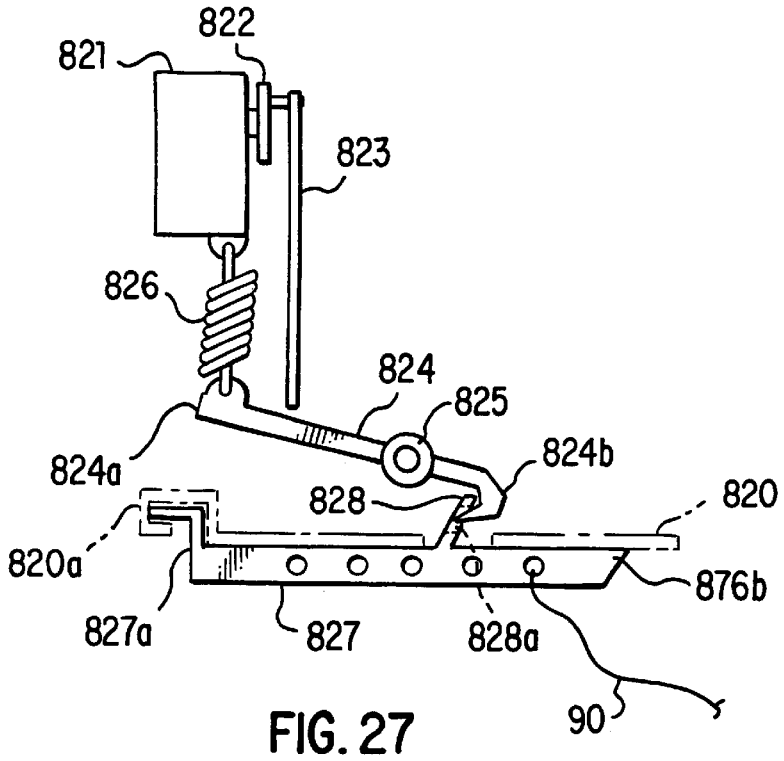
FIG. 27 illustrates a carriage and a releasible flight string of the remotely controlled aircraft shown in FIG. 24.

FIG. 27 illustrates a carriage and a releasible flight string of the remotely controlled aircraft shown in FIG. 24. As shown in FIG. 27, carriage 820 includes RC motor 821, control arm 822, push pin 823, lever 824 and string clip 827. RC motor 821 can rotate control arm 822 based on a received RC signal from the control unit 80. In other words, RC motor 821 includes a servo motor and a receiver that controls the servo motor; as a RC signal is received from the control unit 80, the receiver controls the motor based on the received RC signal. Push pin 823 is connected at one end to control arm 822 and is downwardly engagable with lever 824. Note that any reference to direction in connection with the discussion of FIG. 27 (and FIG. 28 discussed below) is in the frame of reference corresponding to the figures (independent of the particular orientation of the remotely-controlled aircraft 800 at any given time) and is for convenience of discussion only.

Lever 824 is pivotably mounted to the carriage 820 at a mount location 825 between lever ends 824*a* and 824*b*. Lever end 824*a* is coupled to the carriage 820 in any suitable manner so that lever end 824*a* is biased in an upward direction (i.e., an upward directional force is applied to lever end 824*a*). Lever end 824*a* can be coupled to the carriage 820 by a counterbalance member 826. Counterbalance member 826 can be, for example, an extended spring 826 located above the lever end 824*a* (as shown in FIG. 27) or to a compressed spring (not shown) located below the lever end 824*a*. Alternatively, counterbalance member 826 can be a elastic member (not shown) having an end located below the lever end 824*a* that applies an upward directional force on lever end 824*a*. Such an elastic member can be, for example, a substantially horizontal plastic member or a piece of foam that applies upward pressure to lever end 824*a* while capable of flexing sufficiently to allow lever end 824*a* to move downward when pushed by push pin 823.

String clip 827 includes string-clip ends 827*a* and 827*b*, and catch arm 828. The flight string 90, which is connected at one end to the control unit 80, can be connected along various positions of string clip 827 to select the pitch of the aircraft 800 when acting in a kite mode. For example, string clip 827 can have multiple holes along its length with which the flight string 90 can attach.

String-clip end 827*a* can have a portion that complementarily fits within a string-clip retaining cavity 820*a*. For example, the string clip end 827*a* can have an extended, "L" shaped portion that can be rotatably and removably inserted into the string-clip retaining cavity 820*a* that has an opening more narrow than the internal extent of the cavity 820*a*. In this arrangement, the string-clip end 827*a* remains within the string-clip retaining cavity 820*a* while the string clip 827 is maintained in a position substantially parallel with the underside of the carriage 820 (i.e., substantially horizontal as shown in FIG. 27).

The catch arm 828 of string clip 827 is configured to complimentarily fit with the lever end 824*b* so that the lever end 824*b* is removably connected to string clip 827. For example, the catch arm 828 can have a lever cavity 828*a* into which lever end 824*b* can fit, and the lever end 824*b* can have a hook or "J" shape that fits around the catch arm 828 and fits into lever cavity 828*a*.

Figure 28:
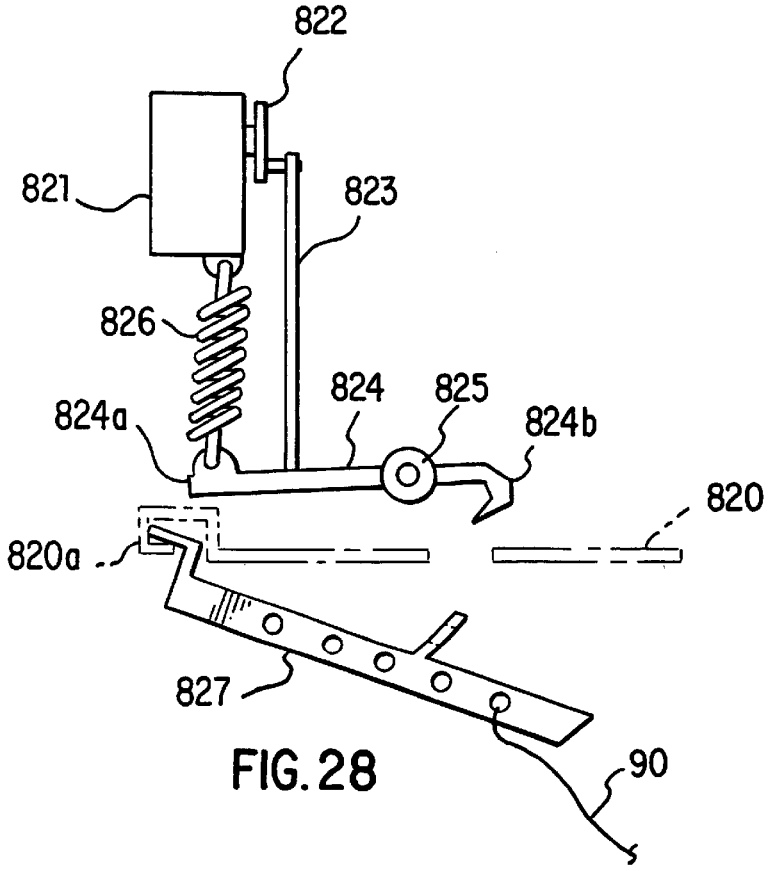
FIG. 28 illustrates the flight string being released from the carriage shown in FIG. 27.

FIG. 28 illustrates the flight string 90 being released from the carriage 820 shown in FIG. 27. When the receiver of RC motor 821 receives a signal sent by RC transmitter of the control unit 80, control arm 822 rotates thereby bringing push pin 823 downward in a direction toward lever 824. By moving push pin 823 downward, the upward force applied at the lever end 824*a* is overcome thereby causing the lever 824 to rotate counterclockwise about mount location 825. As shown in FIGS. 27 and 28, the downward motion of push pin 823 causes the upward force of extended spring 826 to be overcome thereby causing the lever 824 to move downward about mount location 825.

As lever 824 rotates counterclockwise about mount location 825, the lever end 824*b* moves upward and away from catch arm 828 of spring clip 827. As lever end 824*b* moves upward, it moves out of catch cavity 828*a*. Flight string 90 pulls string-clip end 827*b* downward due to the tension in the flight string 90 while remotely-controlled aircraft 800 is in flight. The downward pressure on string-clip end 827*b* causes string-clip end 827*a* to rotate within the string-clip retaining cavity 820*a* and to separate from string-clip retaining cavity 820*a*. Once string clip 827 is separated from carriage 820, remotely-controlled aircraft 800 can function in a remotely-controlled glider mode rather than the kite mode. Note that as the string clip 827 is separated from carriage 820, the tail weight 850 also is separated from center member 812 of the remotely-controlled aircraft 800.

Figure 31:
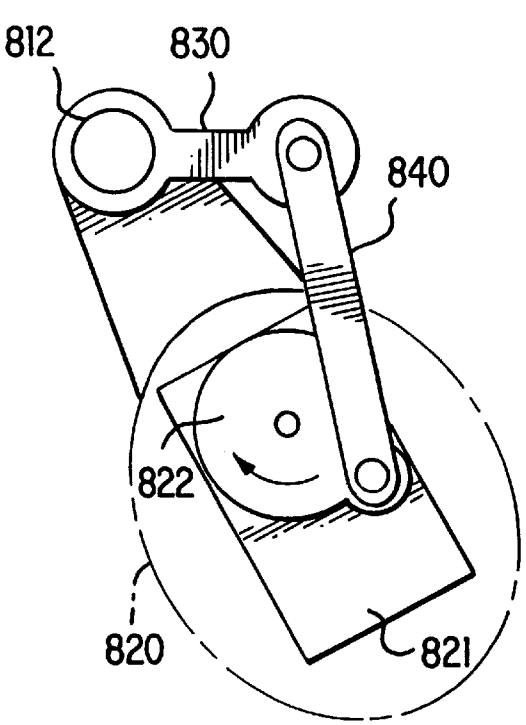
FIGS. 29 through 31 illustrate a front view of the RC motor coupled to the center member of the wing assembly shown in FIGS. 24–26.
Figure 30:
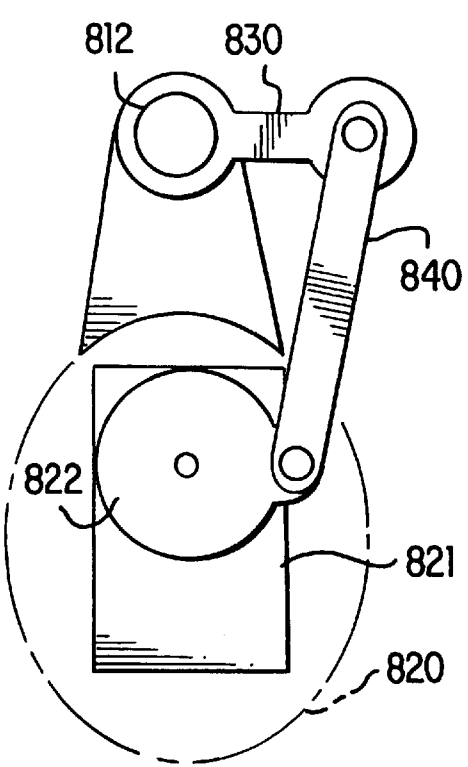
Figure 29:
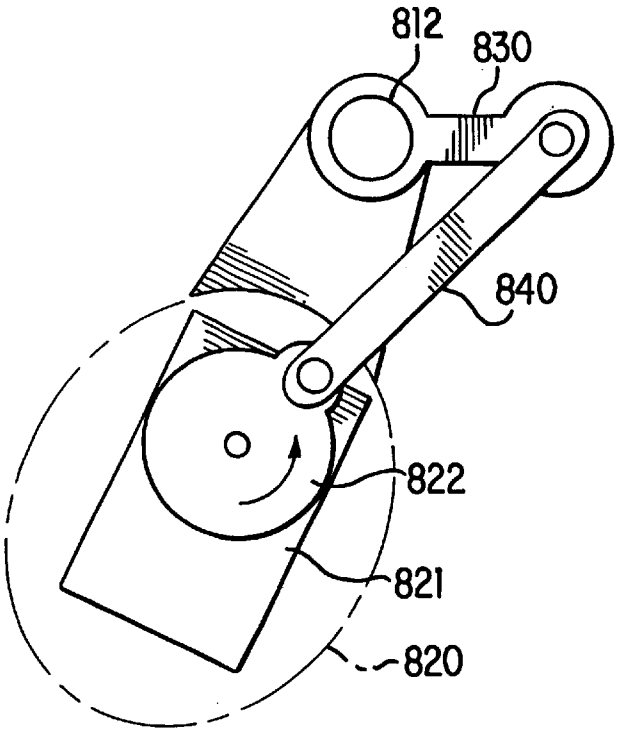

FIGS. 29 through 31 illustrate a front view of the RC motor coupled to the center member of the wing assembly shown in FIGS. 24–26. Carriage 820 is pivotably attached to center member 823. For example, carriage 820 can include a cylindrical portion that allows carriage 820 to pivot or rotate about the center member 812 while not moving axially along center member 812.

RC motor 821 is disposed with carriage 820 and includes control arm 822. Connecting arm 840 has one end which is pivotably connected to control arm 822 and another end which is pivotably connected to one end of a center member arm 830. The opposite end of center member arm 830 is fixedly attached to center member 812. In one embodiment, the center member arm 830 is fixedly attached to center member 812 in a perpendicular arrangement, and the connecting arm 840 is pivotably connected to center member arm 830 so that they are arranged substantially within a plane perpendicular to the center member 812. In other embodiments, the center member arm 830 is fixedly attached to center member 812 in an oblique manner and the connecting arm 840 is not arranged within a plane perpendicular to the center member 812. In sum, the center member arm 830 is fixedly attached to center member 812 in a non-parallel arrangement.

FIG. 30 illustrates the position of control arm 822 when remotely controlled aircraft 800 is in the kite configuration before flight string 90 has been released and when the remotely controlled aircraft 800 has a straight flight direction after the flight string 90 has been released.

FIG. 29 shows a position of control arm 822 and connecting arm 840 when the RC motor 821 has been activated by receiving a signal from the RC transmitter of control unit 80. Upon receiving the signal from the RC transmitter, control arm 822 rotates which causes connecting arm 840 to rotate about the center member arm 830. Connecting arm 840 pushes away from center member arm 830 because it is fixedly attached to the center member 812. This, in turn, causes carriage 820 to pivot around center member 812. By rotating the position of carriage 820 about center member 812, the flight direction of remotely controlled aircraft 800 correspondingly can change.

As shown in FIG. 29 where the front of remotely controlled aircraft 800 is coming out of the page, by rotating the position of carriage 820 with respect to center member 812, the direction of remotely-controlled aircraft 800 changes to the right from the perspective on the aircraft facing forward. In other words, by changing the center of gravity of carriage 820 and, correspondingly remotely-controlled aircraft 800, to the right, the flight direction of remotely controlled aircraft 800 would also change to the right.

Similar to FIG. 29 where the position of carriage 820 has been rotated with respect to center member 812, FIG. 31 also illustrates the position of carriage 820 being rotated in the opposite direction with respect to center member 812. By rotating the position of carriage 820 with respect to center member 812 to the left, the direction of remotely controlled aircraft 800 changes to the left from the perspective on the aircraft facing forward. In other words, by changing the center of gravity of carriage 820 and, correspondingly remotely controlled aircraft 800, to the left, the flight direction of remotely controlled aircraft 800 would also change to the left.

It should, of course, be understood that while the present invention has been described in reference to particular configurations, other configurations should be apparent to those of ordinary skill in the art. For example, an embodiment where the flight direction of the aircraft is remotely controlled can be combined with an embodiment where the lift and drag characteristics of the aircraft are remotely controlled. More specifically, for example, the configuration of the carriage rotating about the center member to remotely control the aircraft can be combined with an actuator arrangement where the lift and drag characteristics of the aircraft can be remotely controlled. In such a configuration, the remote control of the flight direction can be obtained with one RC channel and the remote control of the aircraft's lift and drag characteristics can be obtained with another RC channel where both RC channels controlled within the same control unit and housing assembly.

What is claimed is:

1. In a remotely controlled aircraft, a carriage, said carriage comprising:

a lever having a first end and a second end, said lever being pivotably mounted to said carriage at a mount location between the first end and the second end of said lever, the first end of said lever being biased in an upward direction, said lever between its first end and mount location being downwardly engagable, said lever between its first end and mount location being upwardly engagable; and a string clip having a first end and a second end, the first end of said string clip being removably engagable with the carriage, the second end of said string clip being removably engagable with the second end of said lever.

2. The carriage of claim 1, further comprising:

a push pin having a first end and a second end, the first end of said push pin being downwardly engaged upon the remote control signal being received at the carriage, the second end of a push pin downwardly engagable with said lever between the first end of said lever and the mount location of said lever.

3. The carriage of claim 1, wherein:

the carriage includes an opening defining a string-clip retaining cavity, the first end of said string clip having an extended portion removably and slidably engagable with the string-clip retaining cavity of the carriage.

4. The carriage of claim 3, wherein:

the opening of the carriage is defined by an edge;

the extended portion of said string clip is rotatably engagable with the string-clip retaining cavity about a portion of the edge of the opening of the carriage.

5. The carriage of claim 1, wherein:

the second end of said string clip includes a lever cavity;

the second end of said lever having a hook shape complementarily fitting into the lever cavity of the second end of said string clip.

6. The carriage of claim 1, further comprising:

a counterbalance member having a first end and a second end, the first end of said counterbalance member being connected to the carriage and the first end of said lever.

7. The carriage of claim 1, wherein:

said string clip is attached to a tail weight removably attached to the remotely-controlled aircraft.

8. In a remotely controlled aircraft, a carriage, said carriage comprising:

a remote control motor having a control arm;

a lever having a first end and a second end, said lever being pivotably mounted to said carriage at a mount location between the first end and the second end of said lever, the first end of said lever being biased in an upward direction, said lever between its first end and mount location being engagable with the control arm of said remote control motor; and a string clip having a first end and a second end, the first end of said string clip being removably engagable with the carriage, the second end of said string clip being removably engagable with the second end of said lever.

9. The carriage of claim 8, wherein:

the carriage includes an opening defining a string-clip retaining cavity, the first end of said string clip having an extended portion removably and slidably engagable with the string-clip retaining cavity of the carriage.

10. The carriage of claim 9, wherein:

the opening of the carriage is defined by an edge;

the extended portion of said string clip is rotatably engagable with the string-clip retaining cavity about a portion of the edge of the opening of the carriage.

11. The carriage of claim 8, wherein:

the second end of said string clip includes a lever cavity;

the second end of said lever having a hook shape complementarily fitting into the lever cavity of the second arm of said string clip.

12. The carriage of claim 8, further comprising:

a counterbalance member having a first end and a second end, the first end of said counterbalance member being connected to the carriage and the first end of said lever.

13. The carriage of claim 8, wherein:

said string clip is attached to a tail weight removably attached to the remotely-controlled aircraft.

14. In a remotely controlled aircraft, a carriage, said carriage comprising:

a lever having a first end and a second end, said lever being pivotably mounted to said carriage at a mount location between the first end and the second end of said lever, the first end of said lever being biased in an upward direction, said lever between its first end and mount location being downwardly engagable in response to a remote control signal being received at the carriage; and a string clip removably engagable with the carriage, the string clip having a first end and a second end, the second end of said string clip being removably engagable with the second end of said lever.

15. The carriage of claim 14, further comprising:

a push pin having a first end and a second end, the first end of said push pin being downwardly engaged upon the remote control signal being received at the carriage, the second end of a push pin downwardly engagable with said lever between its first end and mount location.

16. The carriage of claim 14, wherein:

the carriage includes an opening defining a string-clip retaining cavity, the first end of said string clip having an extended portion removably and slidably engagable with the string-clip retaining cavity of the carriage.

17. The carriage of claim 16, wherein:

the opening of the carriage is defined by an edge;

the extended portion of said string clip is rotatably engagable with the string-clip retaining cavity about a portion of the edge of the opening of the carriage.

18. The carriage of claim 14, wherein:

the second end of said string clip includes a lever cavity;

the second end of said lever having a hook shape complementarily fitting into the lever cavity of the second end of said string clip.

19. The carriage of claim 14, further comprising:

a counterbalance member having a first end and a second end, the first end of said counterbalance member being connected to the carriage and the first end of said lever.

20. The carriage of claim 14, wherein:

said string clip is attached to a tail weight removably attached to the remotely-controlled aircraft.

* * * * *